US007927031B2

(12) United States Patent
Kitabatake

(10) Patent No.: US 7,927,031 B2
(45) Date of Patent: Apr. 19, 2011

(54) IMPACT PRINTHEAD

(75) Inventor: Tetsuya Kitabatake, Fukushima (JP)

(73) Assignee: Oki Data Corporation, Tokyo (JP)

( * ) Notice: Subject to any disclaimer, the term of this patent is extended or adjusted under 35 U.S.C. 154(b) by 807 days.

(21) Appl. No.: 11/769,751

(22) Filed: Jun. 28, 2007

(65) Prior Publication Data

US 2008/0014005 A1 Jan. 17, 2008

(30) Foreign Application Priority Data

Jun. 30, 2006 (JP) ..... 2006-180654

(51) Int. Cl.
*B41J 2/265* (2006.01)

(52) U.S. Cl. ..... 400/124.24; 400/124.28

(58) Field of Classification Search ..... 400/124.24, 400/124.25, 124.26, 124.27, 124.28
See application file for complete search history.

(56) References Cited

U.S. PATENT DOCUMENTS 5,011,308 A * 4/1991 Shimosato et al. ..... 400/124.24
5,320,441 A * 6/1994 Yamakawa ..... 400/124.27

FOREIGN PATENT DOCUMENTS

JP 58-062067 A 4/1983
JP 58-104761 A 6/1983
JP 58-187374 A 11/1983
JP 60-262667 A 12/1985
JP 63-051732 A 3/1988
JP 63-197659 A 8/1988
JP 05024213 A * 2/1993
JP 05185610 A * 7/1993
JP 6-106738 A 4/1994
JP 06171115 A * 6/1994
JP 06336037 A * 12/1994

OTHER PUBLICATIONS

European Search Report for European Application No. 07111022.5, dated Feb. 16, 2010 (6 pages).

* cited by examiner

*Primary Examiner* — Daniel J Colilla
(74) *Attorney, Agent, or Firm* — Panitch Schwarze Belisario & Nadel LLP

(57) ABSTRACT

An impact printhead includes impact wires loosely held in a guide and driven to print. The printhead includes individual holes through which corresponding wires extend, and elongated holes formed in the guide for guiding the wires. The elongated hole includes a concave wall and a convex wall opposing each other. The wires are slidable on the convex wall. When the wires are not driven to print, the wires are at rest in pressure contact with the convex wall. Grooves may be formed in place of the elongated holes, and have second walls. The second wall lies substantially in a curved plane in which a first wall lies to define the individual hole. The wire is guided by the hole and groove. When the wire is not driven to print, the wire is at rest in pressure contact with the first and second walls.

6 Claims, 10 Drawing Sheets

IMPACT PRINTHEAD

BACKGROUND OF THE INVENTION

1. Field of the Invention

The present invention relates to an impact printhead in which a plurality of impact wires are driven to print characters on a medium.

2. Description of the Related Art

A dot matrix printer or impact matrix printer employs a printhead that runs back and forth on the page and prints by impact, striking an ink-soaked cloth ribbon against the paper. Impact printers are capable of printing on a variety of media at low cost, and find their application in a variety of areas including an output device in an information processing system. Impact printheads may be of variety of types including a plunger type, a spring-charge type, and a clapper type.

For an impact type printhead, impact wires are fixed to ends of armatures supported on one end of a cantilever type flat spring. A permanent magnet attracts the armature to a core such that mechanical energy is stored in the spring. When printing is performed, current is applied to a coil wound around the core, thereby producing a magnetic flux in a direction opposite to the magnetic flux of the permanent magnet. The magnetic force produced by the produced magnetic flux overcomes the magnetic force produced by the permanent magnet, allowing the flat spring to drive the impact wire. The impact wire moves toward its free end to its extended position, thereby striking the ink ribbon against the print medium to print dots.

FIG. 19 illustrates a conventional impact printhead 1. Referring to FIG. 19, an impact printhead 1 includes a plurality of impact wires 2. The impact wires 2 are each secured at one end thereof to the rip of an armature 3. The armature 3 is fixed to a flat spring 4, so that the armature 3 and flat spring 4 move in unison. The base of the flat spring 4 is, for example, welded to a spacer 5 of a stacked structure of the spacer 5, a yoke 6, a permanent magnet 7, and a yoke 8.

A core 10 is mounted to a base yoke 9 located at the base portion of the impact printhead 1. A coil 11 is wound around the core 10. Current is applied to the coil 11 under control of a controller 12. The core 10 and the flat spring 4 are positioned relative to each other with a gap $\Delta g$ between them. The impact wires 2 extend through a vibration restricting guide 14, and further extend through a wire guide 13 such that the free end portions of the impact wires 2 extend through the wire guide 13.

FIG. 20 illustrates the impact printhead 1 when it is not operating. The armature 3 remains attracted by the flux of the permanent magnet 7 to the core 10. The flat spring 4 flexes to the core so that mechanical energy is stored in the flat spring 4. At this moment, the impact wire 2 is restricted in its movement both in an X direction and in a Y direction by the wire guide 13. In other words, when the impact printhead 1 is not driven, the middle portion of the impact wire 2 has flexed by $\Delta y$ in the Y direction from its position when the impact printhead 1 is driven.

When the controller 12 applies voltage across the coil 11, the coil 11 produces a magnetic flux in a direction opposite to the magnetic flux of the permanent magnet 7, the magnetic flux produced by the coil 11 overcoming the magnetic flux of the permanent magnet 7. Thus, the impact wire 2 projects outwardly from the wire guide 13 in a Z direction to strike the ink soaked cloth ribbon against the print medium. Subsequently, when the controller 12 shuts off the voltage across the coil 11, the core 10 again attracts the armature 3 so that the armature 3 remains attracted until the controller 12 applies voltage across the coil 11 again.

When the impact wire 2 is driven, it moves to an extended position where the impact wire 2 strikes the ink-soaked cloth ribbon against the medium. When the impact wire 2 is not driven, it moves to a retracted position where the impact wire 2 does not strike the ink-soaked cloth ribbon against the medium. Because the impact wire 2 is an elastic body, it vibrates when it returns from the extended position to the retracted position. Thus, shortly after the impact wire 2 reaches the retracted position, the impact wire 2 continues to vibrate with the amplitude decreasing until it is completely damped (higher-order vibration mode). The connection between the impact wire 2 and the armature 3 may be damaged due to repetitive vibration of the impact wire 2. In order to prevent higher-order vibration of the impact wire 2, a vibration restricting guide 14 is provided.

FIG. 21 is a perspective view of the vibration restricting guide 14. FIG. 22 illustrates the operation of the vibration restricting guide 14. Referring to FIGS. 21 and 22, a plurality of holes 15 having a circular cross section are formed in the vibration restricting guide 14. The holes 15 have a diameter slightly larger than that of the impact wire 2. Referring to FIG. 22, if the vibration restricting guide 14 is not employed, the impact wire 2 would be at rest in a dotted line position in FIG. 22. If the vibration restricting guide 14 is employed, the wall 15*a* of the hole 15 holds the impact wire 2 in a solid line position in FIG. 22 where the wall 15*a* pushes the impact wire 2 to displace by $\Delta P$ from the dotted line position. Another way of looking at this situation is that the impact wire 2 resiliently pushes the wall 15*a* of the hole 15 with a pressing force of $\Delta Pw$. The pressing force $\Delta Pw$ prevents higher-order vibration of the impact wire 2 after the impact wire 2 is in the attracted position.

With the aforementioned conventional apparatus equipped with a vibration restricting guide, the impact wire 2 is pressed against the wall 15*a* of the hole 15 at all times when the impact wire 2 is in its retracted state. Thus, repetitive impact operation of the impact wire 2 causes the impact wire 2 to repetitively beat the wall 15*a*, resulting in wear of the wall 15*a*. Wear of the wall 15*a* leads to a larger hole 15, decreasing the pressing force of the impact wire 2 exerted on the wall 15*a*. The wear becomes less effective in damping vibration, and the impact wire 2 and armature become apart eventually.

For prolonging the lifetime of the impact printhead, the vibration restricting guide should be formed of a highly wear-resistant material such as ceramics. Highly wear-resistant materials are more expensive than general purpose resin materials. Thus, the prolonged life and low cost of an impact printhead are difficult to achieve.

SUMMARY OF THE INVENTION

An object of the invention is to provide an impact printhead capable of preventing higher order vibration of impact wires and wear of a wire guide member.

Another object of the invention is to provide an impact printhead in which the life of impact print head is prolonged using the same material.

An impact printhead includes at least one impact wire (2) driven to print and a wire guide (22). The wire guide (32) includes a surface with which the impact wire is in pressure contact after the impact wire has been driven to print, the impact wire being guided by the surface. When the impact wire is at rest after the impact wires has been driven, the impact wire is in pressure contact with the surface at a first position. The impact wire is in pressure contact with the surface at a second position when the impact wire is sliding on the surface.

An impact printhead includes impact wires loosely held in a guide member and driven to print. The impact printhead includes at least one hole, at least one impact wire, and at least one groove. The at least one hole is formed in the guide and defined by a first wall. The at least one impact wire extends through the at least one hole. The at least one groove is formed in the guide member and defined by a second wall, the second wall lying substantially in a curved plane in which the first wall lies. The at least one impact wire is guided by the at least one hole and the t least one groove. When the at least one impact wire is not driven to print, the at least one impact wire is at rest in pressure contact with the first wall and the second wall.

The second wall is one of a plurality of second walls, and the first wall is one of a plurality of first walls.

The groove is in communication with said hole.

The second wall extends in parallel to a direction in which the impact wire extends when the impact wire is not driven to print.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
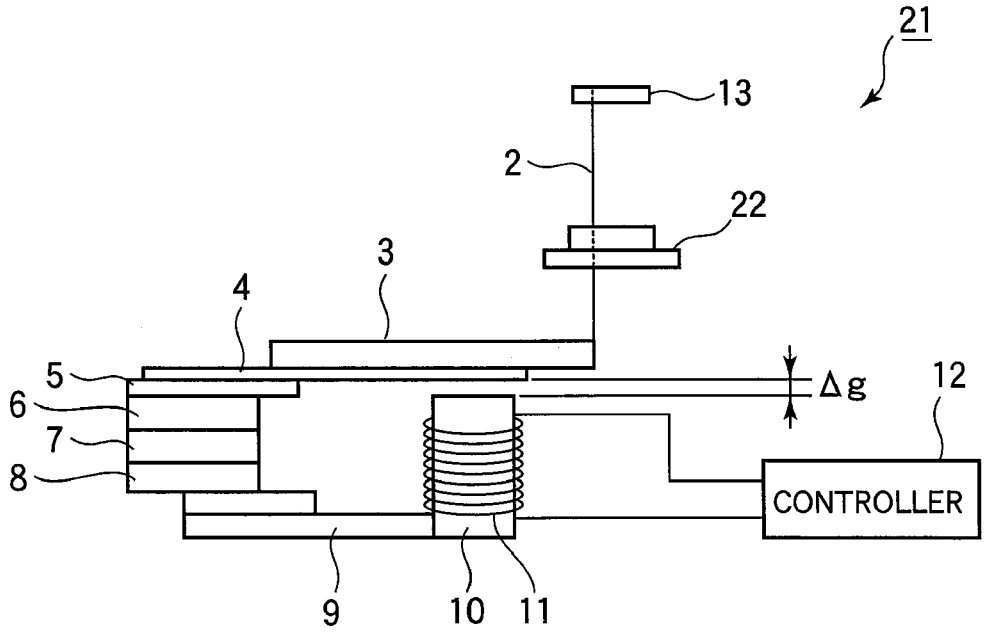
FIG. 1 illustrates a general configuration of an impact printhead of a first embodiment.
Figure 2:
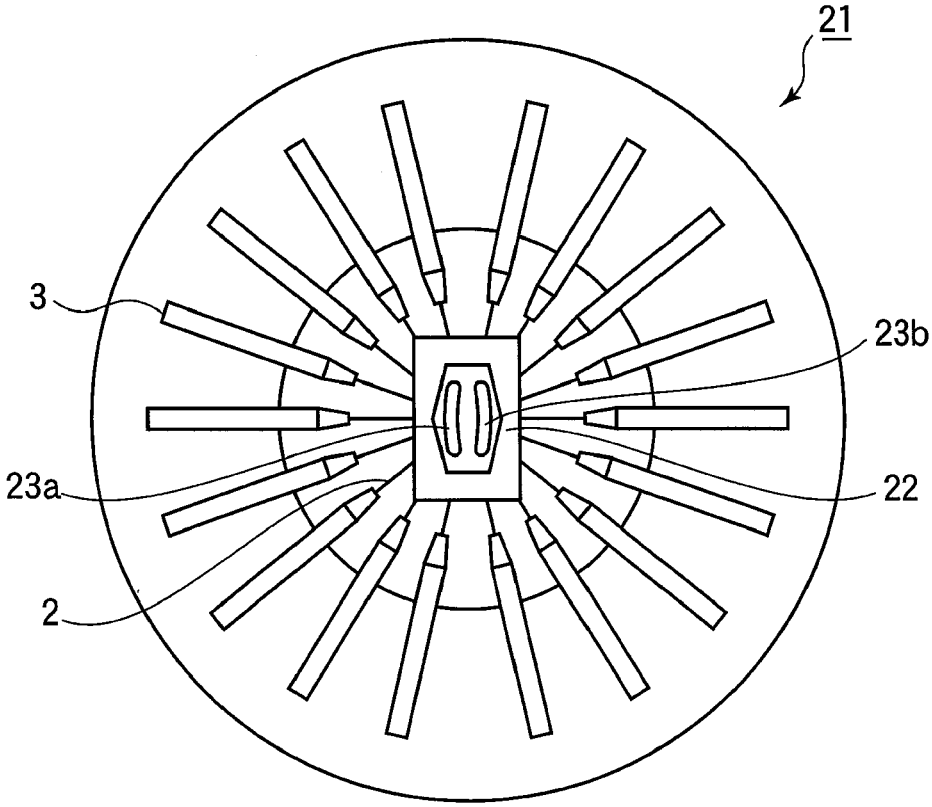
FIG. 2 is a top view of the impact printhead.

The invention will be described in detail with reference to the accompanying drawings. The image apparatus according to the invention will be described with respect to a printer. Similar elements have been given like reference numerals throughout the drawings. FIG. 1 illustrates the general configuration of an impact printhead 21 of a first embodiment. FIG. 2 is a top view of the impact printhead 21. The impact printhead 21 will be described with respect to a spring-charge type impact printhead.

First Embodiment

Referring to FIGS. 1 and 2, the impact printhead 21 includes a plurality of impact wires 2, secured to the end portion of an armature 3. FIG. 1 shows only one of the impact wires 2. The armature 3 is secured to a flat spring 4 such that the armature 3 and the flat spring 4 operate in unison. The base of the flat spring 4 is, for example, welded to a spacer 5 of a stacked structure of the spacer 5, a yoke 6, a permanent magnet 7, and a yoke 8.

A core 10 is mounted to a base yoke 9 located at the base portion of the impact printhead 21. A coil 11 is wound around the core 10. Current is applied to the coil 11 under control of a controller 12. The core 10 and the flat spring 4 are positioned relative to each other with a gap $\Delta g$ between them. The impact wires 2 extend at their middle portion through a vibration restricting guide 22, and further extend through a wire guide 13 such that the free end potions of the impact wires 2 project through the wire guide 13 when the impact wires 2 are driven. The vibration restricting guide 22 includes two elongated holes 23*a* and 23*b* through which the impact wires 2 extend loosely. The holes 23*a* and 23*b* each include a concave wall 24*b* and a convex wall 24*a* that oppose each other. The impact wires 2 are slidable on the convex wall. When the impact wires are not driven to print, the impact wire is at rest in pressure contact with the convex wall.

Figure 3:
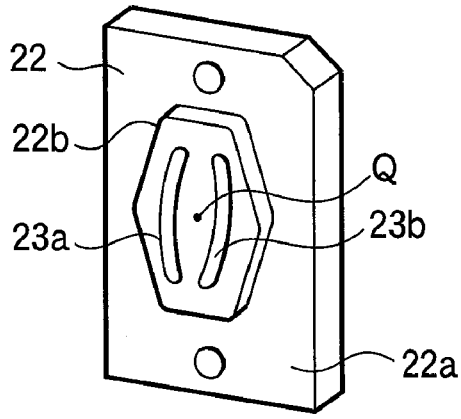
FIG. 3 is a perspective view of a vibration restricting guide.
Figure 4A:
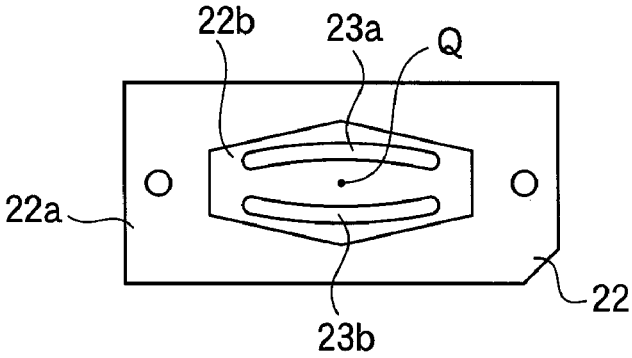
FIG. 4A is a top view of the vibration restricting guide.
Figure 4B:
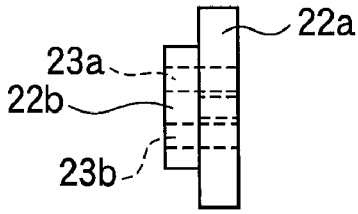
FIG. 4B is a side view of the vibration restricting guide.
Figure 4C:
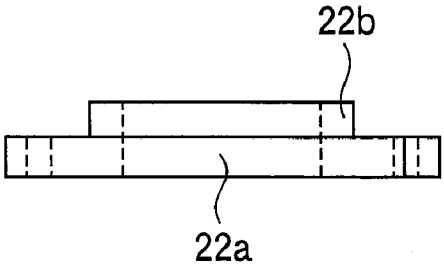
FIG. 4C is a front view of the vibration restricting guide.

FIG. 3 is a perspective view of the vibration restricting guide 22. FIG. 4A is a top view of the vibration restricting guide 22. FIG. 4B is a side view of the vibration restricting guide 22. FIG. 4C is a front view of the vibration restricting guide 22. The vibration restricting guide 22 includes a base 22*a* and a projection 22*b* formed on the base 22*a*. The base 22*a* and a projection 22*b* are of one piece construction. The holes 23*a* and 23*b* are formed to extend through the projection 22*b* and the base 22*a*, and are positioned such that the holes 23*a* and 23*b* are closer to each other at their arcuate end portions than at their middle portions. The provision of the projection 22*b* is effective in increasing the area of the impact wire 2 in contact with the vibration restricting guide 22.

Figure 5:
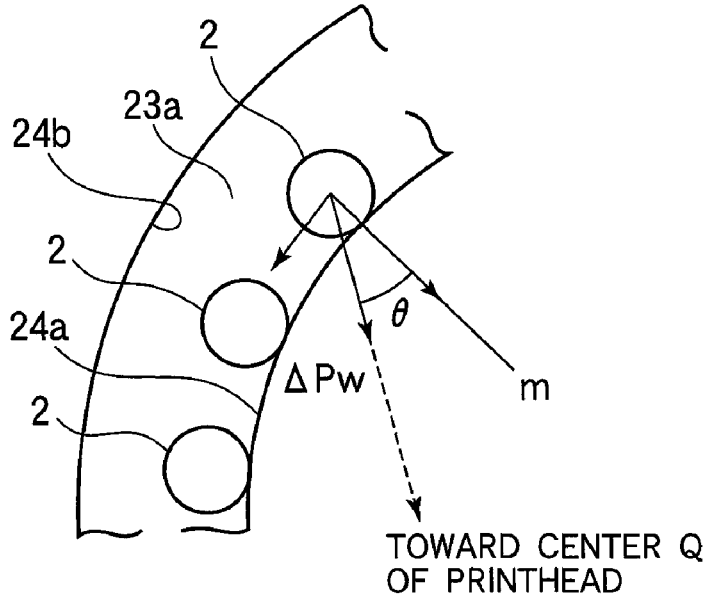
FIG. 5 illustrates impact wires when they are not driven.

FIG. 5 illustrates the impact wires 2 are in the hole 23*a* when the impact wires 2 are not driven, i.e., the armatures 3 are attracted to the magnets 10. Referring to FIG. 5, the impact wires 2 are in pressure contact with a wall 24*a* of the hole 23*a* under a pressing force $\Delta Pw$ for preventing higher-order vibration of the impact wires 2. The pressing force $\Delta Pw$ is acting in a direction shown by "m" perpendicular to a direction tangent to the wall 24*a* at a position where the impact wires 2 press the wall 24*a*. In other words, the ΔPw is resolved into a component ΔPwn in the direction tangent to the wall 24*a* and a component ΔPwm in the m direction. The pressing force ΔPw is at an angle of θ1 (θ1>0) with the m direction.

Figure 6:
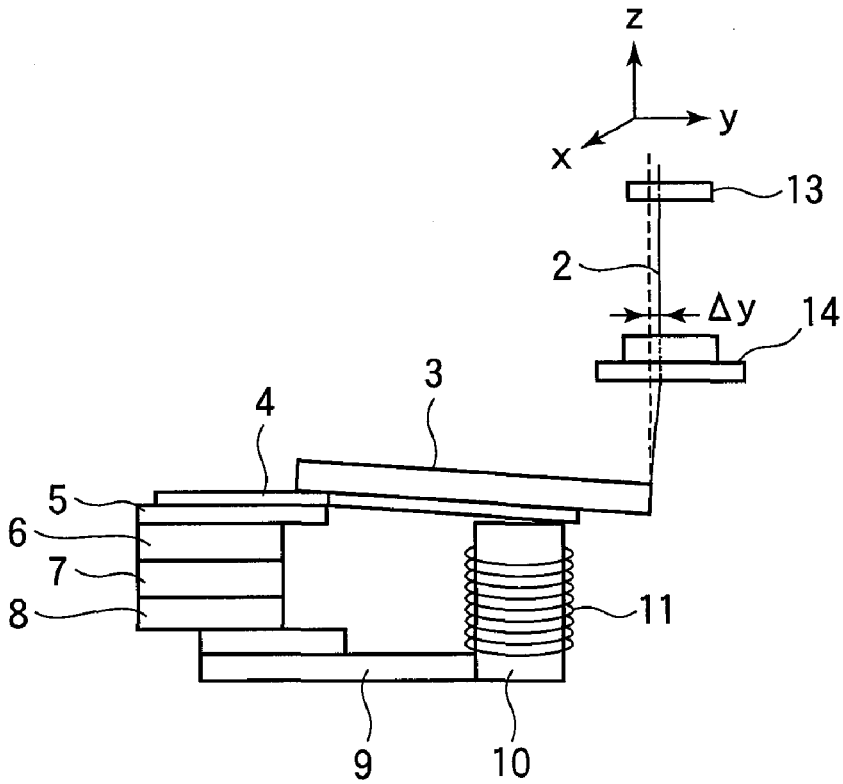
FIG. 6 illustrates the impact printhead when it is not driven.

The operation of the impact printhead of the first embodiment will be described. FIG. 6 illustrates the impact printhead when it is not driven to strike the ink-soaked cloth ribbon. The armature 3 remains attracted to the core 10 by the magnetic flux of the permanent magnet 7. Thus, the flat spring 4 flexes to store mechanical energy therein. At this moment, the impact wire 2 is restricted in its movement both in an X direction and in a Y direction by the wire guide 13. In other words, when the impact printhead 1 is not driven, the middle portion of the impact wire 2 has flexed by Δy in the Y direction from its position when the impact printhead 1 is driven.

When voltage is applied across the coil 11 under control of the controller 12, the coil 11 produces a magnetic flux in a direction opposite to the magnetic flux of the permanent magnet 7, the magnetic flux produced by the coil 11 overcoming the magnetic flux of the permanent magnet 7. Thus, the mechanical energy stored in the flat spring 4 causes the impact wire 2 to project outwardly from the wire guide 13 in a Z direction, the impact wire 2 striking the ink-soaked cloth ribbon against the print medium. Subsequently, when the controller 12 shuts off the voltage across the coil 11, the armature 3 again attracts the core 10, so that the armature 3 remains attracted until the controller 12 again applies voltage across the coil 11.

Figure 7A:
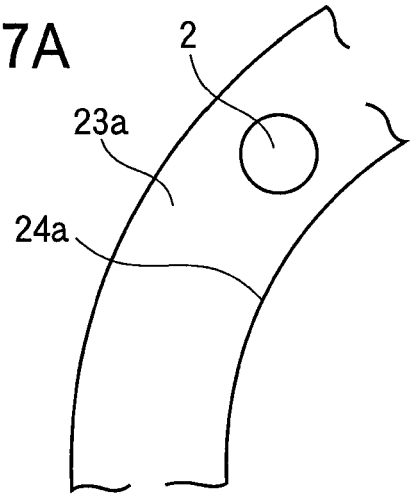
FIGS. 7A-7C illustrate the behavior of the impact wire in a hole of the vibration restricting guide.
Figure 7B:
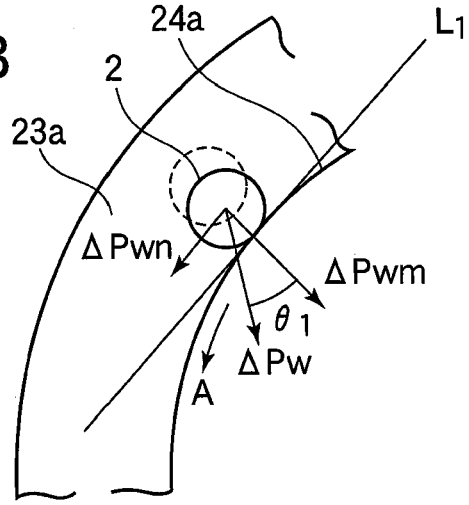
Figure 7C:
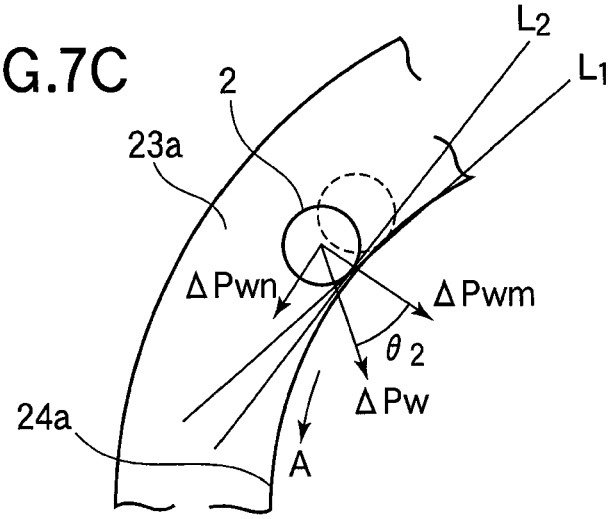

FIGS. 7A-7C illustrate the behavior of the impact wire 2 in the hole 23*a* of the vibration restricting guide 22. When the impact wire 2 is driven to strike the ink-soaked cloth ribbon against the medium, the impact wire 2 leaves the wall 24*a* as shown in FIG. 7A. Immediately after the controller 12 has shut off the voltage across the coil 11, the impact wire 2 presses the wall 24*a* with a pressing force ΔPw at a position through which a tangential line L1 passes. In other words, the impact wire 2 moves from the dotted line position to the solid line position. The pressure contact of the impact wire 2 against the wall 24*a* prevents the impact wire 2 from being subjected to high-order vibration.

As described above, the pressing force ΔPw may be resolved into the component ΔPwn in a direction parallel to a line L1 tangent to the wall 24*a* and the component ΔPwm in a direction perpendicular to the component ΔPwn. The direction of the component ΔPwm makes an angle θ1 with the direction of the pressing force ΔPw. The component ΔPwn acts on the impact wire 2, causing the impact wire 2 to move in a direction shown by arrow A. Because there is no obstacle to the movement of the impact wire 2, the impact wire 2 slides on the wall 24*a* from the dotted line position to the solid line position in the A direction as shown in FIG. 7C.

As soon as the impact wire 2 begins to flex to move in the A direction, a restoring force is developed in the impact wire 2. The restoring force acts on the impact wire 2 in the opposite direction to the component ΔPwn. The longer the distance over which the impact wire 2 moves, the larger the restoring force becomes. The impact wire 2 stops at a position (solid line position in FIG. 7C) where the component ΔPwn and the restoring force are in equilibrium.

After the impact wire 2 has moved to the FIG. 7C position, the impact wire 2 is in contact with the wall 24*a* at a position through which a line L2 tangent to the wall 24*a* passes. The direction of the pressing force ΔPw forms an angle θ2 with the direction of the pressing force ΔPwm tangential line L1. The angle θ2 is larger than the angle θ1.

As a result, ΔPwm' of the impact wire 2 after the impact wire 2 has moved to the solid line position in FIG. 7C is smaller than ΔPwm of the impact wire 2 when the impact wire 2 was at the solid line position in FIG. 7B, i.e., ΔPwm>ΔPwm'.

A pressing force P' per unit area after the impact wire 2 has moved to FIG. 7C position is given by P'=ΔPwm'/S where S is an area of the impact wire 2 in contact with the wall 24*a*. A PV value is expressed by P'V=ΔPwm'/S where V is a velocity of the impact wire 2 when the impact wire 2 moves along the wall 24*a* and S is a surface area of the impact wire 2 in contact with the wall 24*a*.

Figure 8:
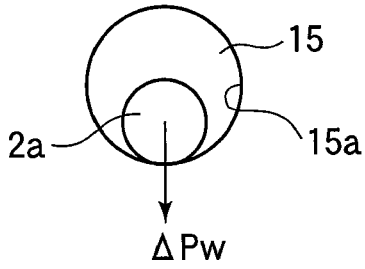
FIG. 8 illustrates the wear of the vibration restricting guide.

A conventional PV value is given as follows:

FIG. 8 illustrates the wear of the vibration restricting guide. When the impact wire 2 presses the wall 15*a* of the hole 15 of the vibration restricting guide 14 as shown in FIG. 8, a PV value is expressed by PV=ΔPw×V/S. Because ΔPw>ΔPwm>ΔPwm', the PV of the conventional art and the PV' of the present invention are related such that PV>P'V.

The first embodiment allows the impact wires 2 to slide on the convex walls of the holes 23*a* and 23*b* while applying only a small pressing force on the walls 24*a*, so that wear of the vibration restricting guide 22 may be minimized and the useable life of the impact wire 2 may be prolonged. Because the impact wires 2 slide on the walls of the holes 23*a* and 23*b* after the impact wires 2 are attracted to the core 10 and then stops, the impact wires 2 are prevented from plastically deforming.

Figure 9:
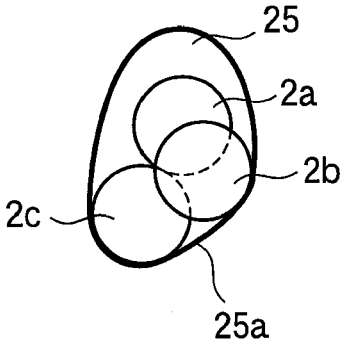
FIG. 9 illustrates a modification to the first embodiment.

FIG. 9 illustrates a modification to the first embodiment. The first embodiment has been described in terms of curved elongated holes 23*a* and 23*b* such that a plurality of impact wires 2 may be loosely received, each impact wire 2 may be inserted through a corresponding single hole 25 having a shape of a deformed triangle with rounded corners as shown in FIG. 9. The hole 25 includes an equilibrium position (rounded corner position) 25*b* that the impact wire 2 takes up shortly after the impact wire 2 is attracted to the core 10 and another equilibrium position (rounded corner position) 25*c* to which the impact wire 2 slides from the position 25*b*. When the impact wire 2 is driven to strike the ink-soaked cloth ribbon against the medium, the impact wire 2 takes up a position 25*a* where the impact wire 2 is not in contact with the wall of the hole 25.

Second Embodiment

Figure 10:
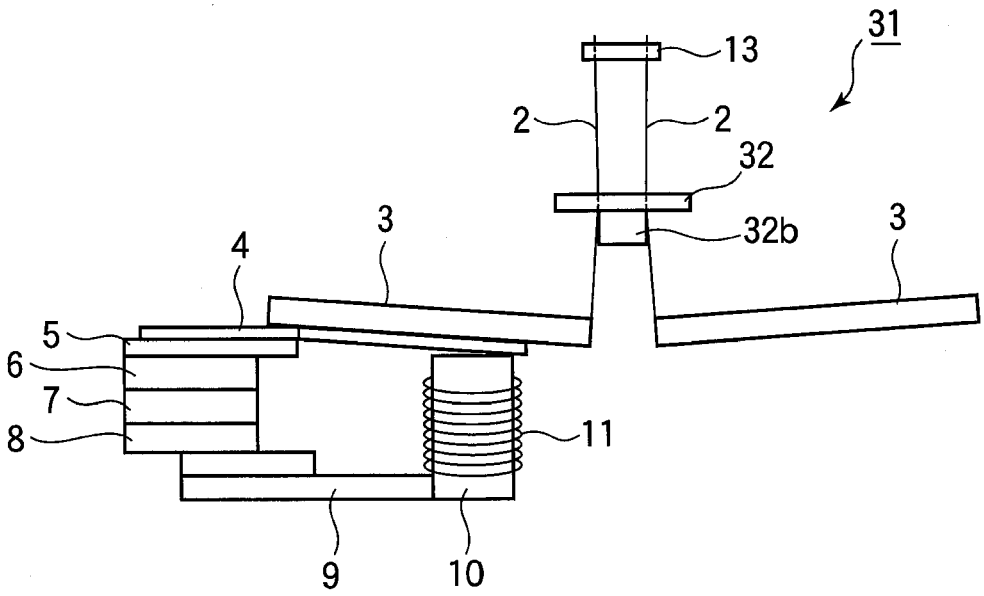
FIG. 10 illustrates an impact printhead of a second embodiment.
Figure 11:
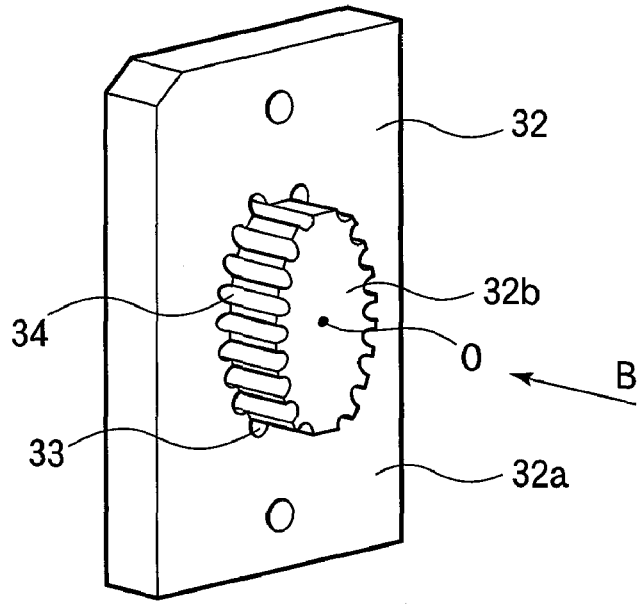
FIG. 11 is a perspective view of a vibration restricting guide of the second embodiment.

FIG. 10 illustrates an impact printhead 31 of a second embodiment. FIG. 11 is a perspective view of a vibration restricting guide 32 of the second embodiment. The impact printhead 31 differs from the impact printhead 21 in that the vibration restricting guide 32 is used.

Figure 12:
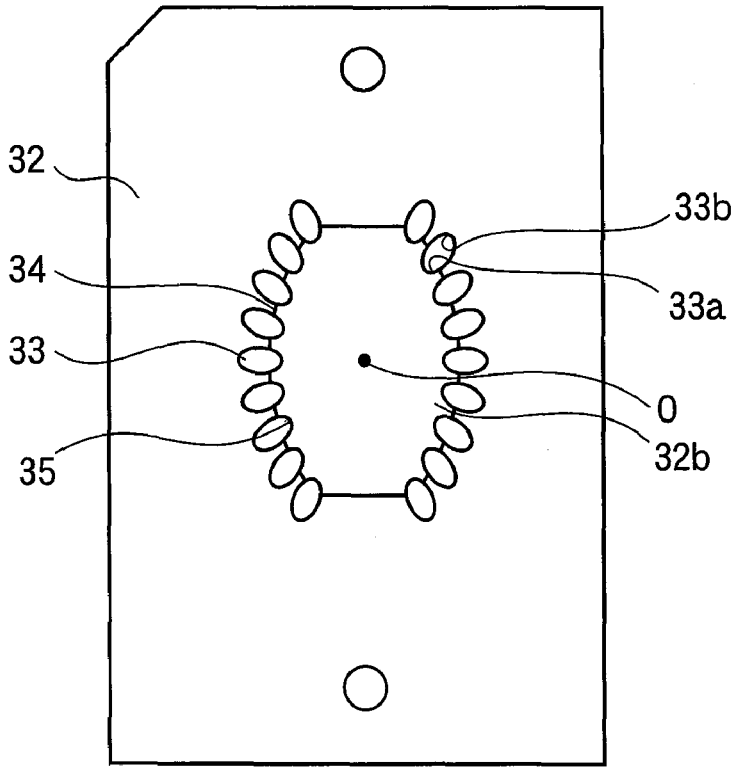
FIG. 12 is a front view illustrating the vibration restricting guide as seen in a direction shown by arrow B.

The vibration restricting guide 32 includes a base 32*a* and a projection 32*b* formed on an upper portion of the base 32*a*. The base 32*a* and the projection 32*b* are in one piece construction. As describe later, the projection 32*b* provides an additional wall surface through which the impact wire 2 contacts the vibration restricting guide 32. The hole 33 has a cross-section in the shape of an ellipse. The major axis of the ellipsoidal cross-section is in line with a line passing through the center "O" of the printhead 31. FIG. 12 is a front view illustrating the vibration restricting guide 32 as seen in a direction shown by arrow B.

The impact wire 2 tends to move toward the center "O" when the impact wire 2 is attracted to a core 10. Orienting the major axis of the hole 33 as described above allows the impact wire 2 to exert a predetermined pressing force against the wall 33*a* toward the center "O" when the impact wire 2 is not driven (i.e., attracted to the core 10, and to move to a wall 33*b* in a direction away from the center "O" when the impact wire 2 is driven to strike the ink-soaked cloth ribbon). The major axes of the holes 33 are oriented such that all of the impact wires 2 exert a predetermined pressing force against the corresponding wall 33*a* toward the center "O" when the impact wires 2 are not driven.

The projection 32*b* includes a plurality of grooves 35 formed in its side surface. The groove 35 has a cross section substantially the same as a part of the hole 33, such that the wall of the groove 35 lies substantially in a curved plane in which the wall 33*a* lies. The height of the projection 32*b* is selected appropriately, allowing for wear of the vibration restricting guide 32. The length of the hole 33 (i.e., the thickness of the base 32*a*) may be selected as required.

Figure 13:
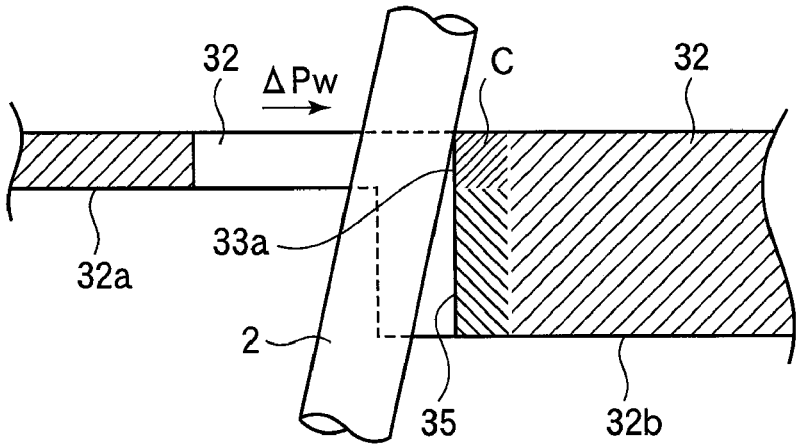
FIG. 13 illustrates the impact wire when the impact wire is attracted to the core.

The printing operation of the second embodiment is substantially the same, and the description is omitted. Here, a description will be given of the operation of the vibration restricting guide 32 when the impact wires 2 are driven to strike the ink-soaked cloth ribbon and when the impact wires 2 are not driven (i.e., attracted to the core 10). FIG. 13 illustrates the impact wire 2 when the impact wire 2 is attracted to the core 10. Referring to FIG. 13, the impact wire 2 applies a pressing force ΔPw to the wall 33*a* of the hole 33.

Figure 14:
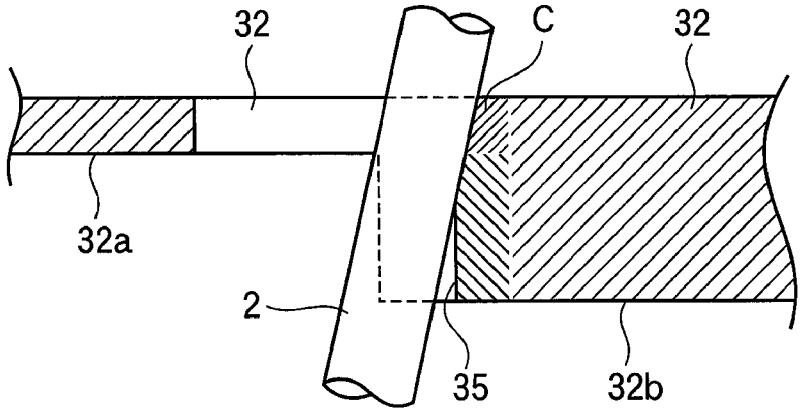
FIG. 14 illustrates the impact wire when the impact wire is in contact with the groove.

FIG. 14 illustrates the impact wire 2 when the impact wire 2 is in contact with the groove 35. Repetitive printing first causes a corner portion C (fine hatching lines originating from the upper right corner) of the wall 33*a* of the hole 33 to wear out gradually as shown in FIG. 13, so that the impact wire 2 will eventually cause wear-out of the wall (fine hatching lines originating from the upper left corner) of the groove 35 formed in the projection 32*b* as shown in FIG. 14. This increases the surface area of the impact wire 2 in contact with the vibration restricting guide 32.

The wear of the vibration restricting guide 32 may be expressed in terms of PV value as follows:

$$P''=\Delta Pw/(S1+S2)$$

$$P''V=\Delta Pw\times V/(S1+S2)$$

where P" is a pressing force per unit area after the impact wire 2 has moved to the wall 33*a* in a direction away from the wall 33*b* ΔPw is a pressing force exerted by the impact wire 2, S1 is a surface area of the wall 33*a* in contact with the impact wire 2, and S2 is a surface area of the wall of the groove 35 in contact with the impact wire 2.

For comparison purpose, a conventional PV value may be expressed as follows:

$$PV=\Delta Pw\times V/S$$

where ΔPw is the pressing force of the impact wire 2 exerted on the wall 15*a* of the hole 15 of the vibration restricting guide 14 (FIG. 8). Assuming that the surface area S of the impact wire 2 in contact with the vibration restricting guide 32 is S≈S1, the surface area S is smaller than that of the second embodiment by the area S2. Thus, it follows that PV>P"V, which retards wear of the vibration restricting guide 32.

Figure 15:
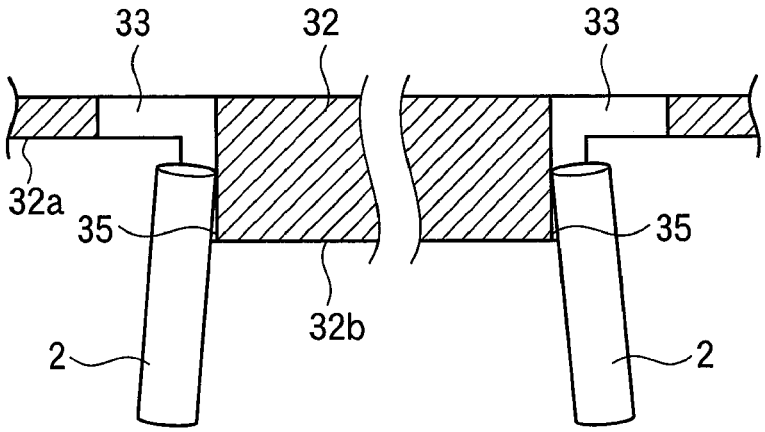
FIGS. 15 and 16 illustrate the insertion of the impact wire into the hole.
Figure 16:
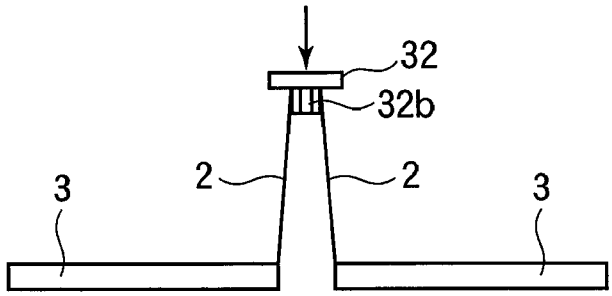

FIGS. 15 and 16 illustrate the insertion of the impact wire 2 into the hole 33. The projection 32*b* is formed with a plurality of grooves 35. The cross-section of the groove 35 is substantially the same as a part of the cross section of the hole 33, such that the curved wall of the groove 35 lies substantially in a curved plane in which the wall 33*a* of the hole 33 of the base 32 lies. This is advantageous in that when the impact wires 2 are assembled into the vibration restricting guide 32, the tip of the impact wire 2 is first placed in the groove 35 as shown in FIG. 15 and then the vibration restricting guide 32 is lowered (alternatively the impact wire 2 may be pushed upward) as shown in FIG. 16. This facilitates smooth insertion of the impact wires 2 into the holes 33 of the base 32.

As described above, the vibration restricting guide 32 includes the projection 32*b* having grooves formed in its side surface. Each projection 32*b* is in communication with a corresponding hole 33. Each groove has a curved wall that lies in substantially the same curved plane as the curved wall of the corresponding hole 33 formed in the base 32. This configuration increases the wear margin of the impact wire 2 such that the area of the impact wire 2 in contact with the vibration restricting guide 32 increases with increasing wear of the vibration restricting guide 32. Therefore, this prolongs the life time of the impact wire 2 before the impact wire 2 wears out to a level where the impact wire 2 no longer contacts the vibration restricting guide 32.

When the impact wire 2 is assembled into the vibration restricting guide 32, the tip of the impact wire 2 is first placed in the groove 35. The tip of the impact wire 2 is then guided into the hole 33 in the vibration restricting guide 32. This improves assembly efficiency.

The base 32*a* of the vibration restricting guide 32 has substantially the same thickness as the conventional vibration restricting guide 32, allowing manufacturing of the vibration restricting guide by using much the same manufacturing processes as the conventional vibration restricting guide.

Figure 17:
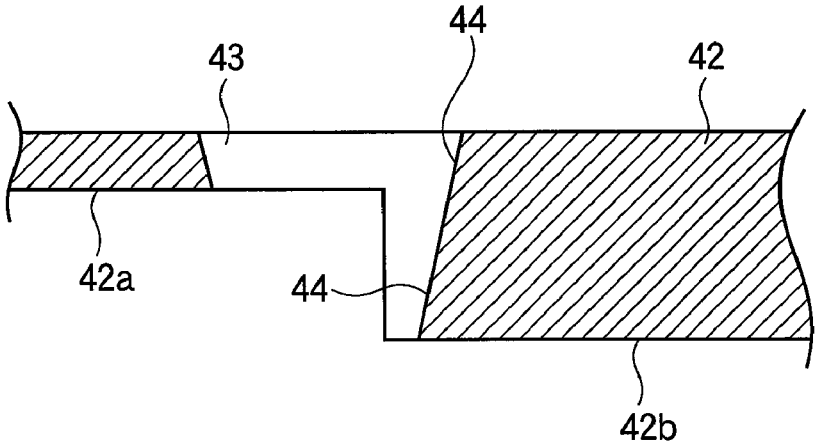
FIG. 17 illustrates a modification to the vibration restricting guide of the second embodiment.

FIG. 17 illustrates a modification to the vibration restricting guide 42 of the second embodiment. Referring to FIG. 17, a vibration restricting guide 42 includes a base 42*a* and a projection 42*b*. The base 42*a* is formed with holes 43 (only one hole is shown) therein. The wall of a groove 45 formed in the projection 42*b* and a wall 44 of the hole 43 are tapered such that the walls extend in a direction parallel to the surface of the impact wire 2 inclined.

Figure 18:
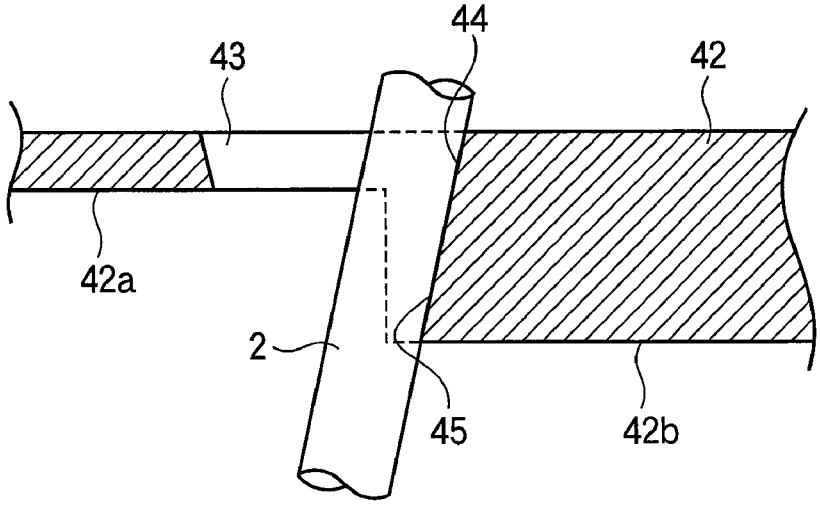
FIG. 18 illustrates the vibration restricting guide and the impact wire when the impact wire is attracted to the core.
Figure 19:
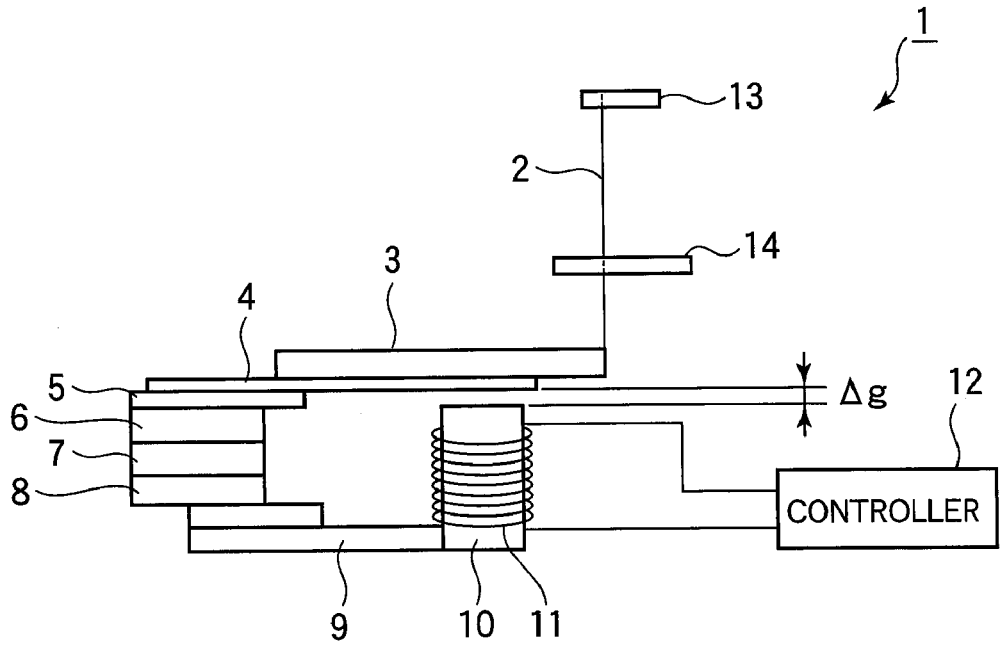
FIG. 19 illustrates a conventional impact printhead.
Figure 20:
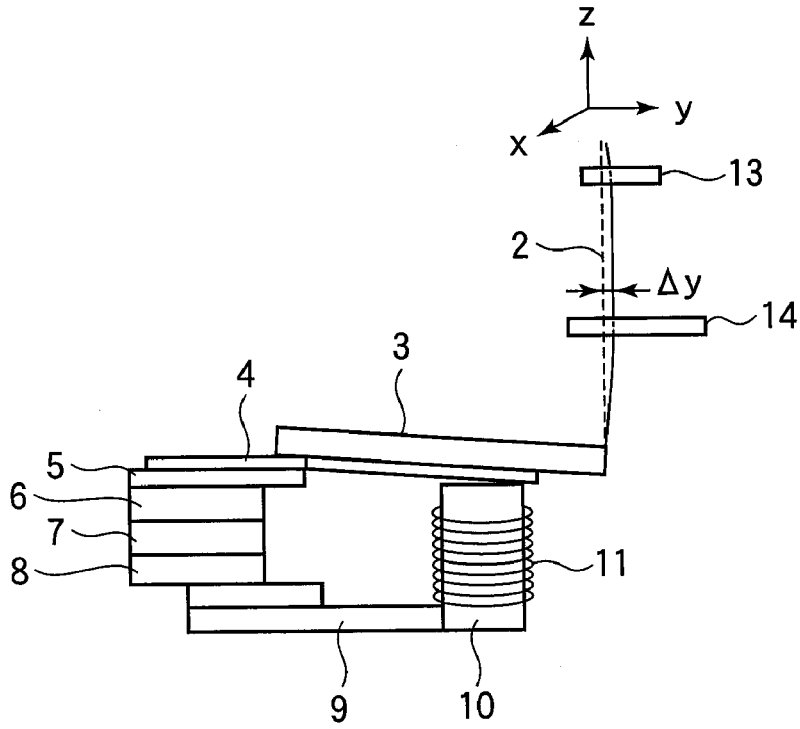
FIG. 20 illustrates the conventional impact printhead when it is not operating.
Figure 21:
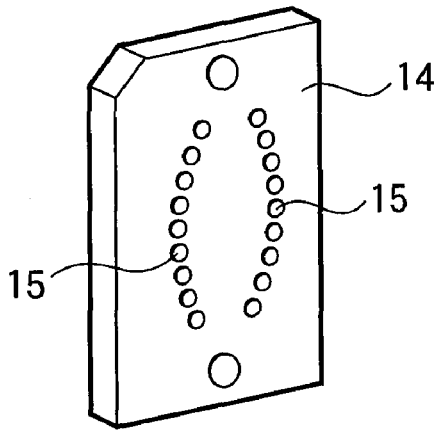
FIG. 21 is a perspective view of the vibration restricting guide.
Figure 22:
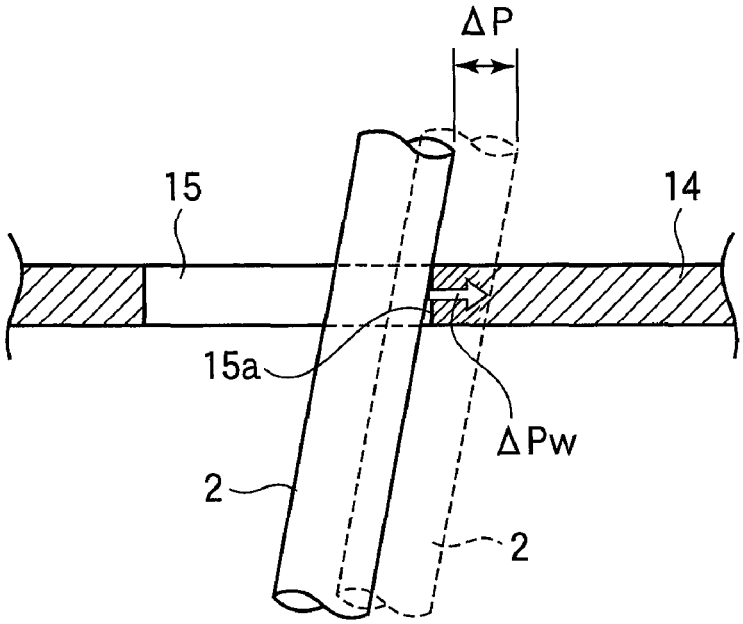
FIG. 22 illustrates the operation of the vibration restricting guide.

FIG. 18 illustrates the vibration restricting guide 42 and the impact wire 2 when the impact wire 2 is attracted to the core 10. Referring to FIG. 18, the impact wire 2 extends in parallel to the tapered wall of the hole 43 and the groove 45, and contacts the tapered wall. Therefore, the impact wire 2 may have a large area in contact with the vibration restricting guide 42 from the early stage of use.

In this modification, the wear of the vibration restricting guide 42 may be expressed in terms of PV value as follows:

$$P''=\Delta Pw/(S1+S2)$$

$$P''V=\Delta Pw\times V/(S1+S2)$$

where P" is a pressing force per unit area after the impact wire 2 has moved to the wall 33*a* in the direction away from the wall 33*b*, ΔPw is a pressing force exerted by the impact wire 2, S1 is a surface area of the wall 33*a* of the base 32*a* in contact with the impact wire 2, and S2 is a surface area of the wall of the groove 35 in contact with the impact wire 2. Thus, the wear of the vibration restricting guide may be retarded from the beginning of the use of the impact print head.

The tapered hole 43 formed in the vibration restricting guide 42 improves detachability of the vibration restricting guide from a mold, thereby improving manufacturing efficiency of the impact print head.

Various modifications may be made. For example, the hole 25 in FIG. 9 of the first embodiment may be combined with the second embodiment, thereby retarding wear of the vibration restricting guide.

What is claimed is:

1. An impact printhead in which at least one impact wire is driven to print, the impact printhead comprising:

a wire guide including a convex surface with which the impact wire is in pressure contact after the impact wire has been driven to print, the impact wire being guided by the convex surface; and wherein when the impact wire is at rest after the impact wires has been driven, the impact wire is in pressure contact with the convex surface at a first position;

wherein the impact wire is in pressure contact with the convex surface at a second position when the impact wire is sliding on the convex surface.

2. The impact printhead according to claim 1, wherein the impact wire exerts a pressing force on the convex surface in a direction perpendicular to a direction tangent to the convex surface.

3. The impact printhead according to claim 1, wherein the impact printhead comprises a plurality of impact wires, and the convex surface guides the plurality of impact wires.

4. The impact printhead according to claim 1, wherein the convex surface is a part of a wall that defines a hole formed in said wire guide, the impact wire being a single impact wire that extends through the hole.

5. An impact printhead in which impact wires are loosely held in a guide and are driven to print, the impact printhead comprising:

an elongated hole formed in the guide and defined by two opposing walls, at least one of the two opposing walls being a convex wall; and at least one impact wire extending through said elongated hole, said at least one impact wire being slidable on the convex wall; and wherein after said at least one impact wire has been driven to print, said at least one impact wire is at rest in pressure contact with the convex wall.

6. The impact printhead according to claim 5, wherein said elongated hole is generally in the shape of an arc, and said the convex wall guides a plurality of impact wires.

* * * * *